United States Patent [19]

Mair

[11] 4,439,144

[45] Mar. 27, 1984

[54] DEVICE FOR FIXING RECORDINGS CONSISTING OF POWDERY MATERIAL APPLIED TO A TAPE-SHAPE RECORDING MEDIUM WITH THE ASSISTANCE OF SOLVENT VAPOR

[75] Inventor: Eduard Mair, Munich, Fed. Rep. of Germany

[73] Assignee: Siemens Aktiengesellschaft, Berlin & Munich, Fed. Rep. of Germany

[21] Appl. No.: 369,888

[22] Filed: Apr. 19, 1982

[30] Foreign Application Priority Data

Apr. 28, 1981 [DE] Fed. Rep. of Germany ..... 3116828

[51] Int. Cl.[3] ..... F27B 9/28; F27D 1/18; F26B 13/00; F26B 25/00

[52] U.S. Cl. ..... 432/59; 34/157; 34/242; 432/242

[58] Field of Search ..... 432/8, 59, 242; 34/157, 34/242

[56] References Cited

U.S. PATENT DOCUMENTS

| | | | |
|---|---|---|---|
| 2,873,597 | 2/1959 | Fahringer | 34/242 |
| 2,909,980 | 10/1959 | Wilde | 34/242 |
| 3,078,589 | 2/1963 | Carlson | 34/77 |
| 4,264,304 | 4/1981 | Hausmann | 432/59 |

*Primary Examiner*—John J. Camby

*Attorney, Agent, or Firm*—Hill, Van Santen, Steadman & Simpson

[57] ABSTRACT

A solvent vapor toner image fixing device for use with electrostatic printing or copying devices having a well-shaped container through which a paper web is guided in a loop shaped manner is provided with improved apparatus for sealing the operational opening of the container against the emergence of solvent vapor. The sealing means comprises a wedge-shaped sealing strip disposed beneath the upper reversing drum which conducts the paper web out of the container. The sealing strip defines an air flow gap with the drum which permits an introduction of air flow into the upper end of the container from which it exits through a narrow gap formed between an upper edge container wall and the upper surface of the paper guide member, thus forming a pressure zone at the upper end of the container which resists passage of solvent vapor out of the container. The assembly further includes a discharge housing through which the paper web immediately passes upon leaving the container. The discharge housing is provided with a forced air flow in counterflow relationship to the movement of the paper web such that solvent residues are evaporated from the paper web and prevented from being conducted away from the fixing station on the recording medium.

9 Claims, 6 Drawing Figures

DEVICE FOR FIXING RECORDINGS CONSISTING OF POWDERY MATERIAL APPLIED TO A TAPE-SHAPE RECORDING MEDIUM WITH THE ASSISTANCE OF SOLVENT VAPOR

BACKGROUND OF THE INVENTION

1. Field of the Invention

The invention relates to a fixing station assembly for fixing toner images produced on a recording medium in an electrostatic printing or copying machine and, more particularly, to apparatus for fixing powder toner images applied to a recording medium, such as a paper web, by means of solvent vapor.

2. Prior Art

Device arrangements for fixing powder toner images applied to a recording medium by means of solvent vapor for use in non-mechanical printing and copying machines utilizes electrostatic principles are known in the art, such as shown, for example, in U.S. Pat. Nos. 4,264,304 and 3,078,589. One such fixing station device of known construction is shown in FIG. 1. There, character images inked with toner powder material in a suitable developer station are carried on a paper web recording medium AT to a fixing station having a well-shaped receptacle BH through which the paper web is guided in a loop shaped manner. The paper web AT enters the upper end of the container BH about an upper support or guide member PF having an arcuately curved surface. The upper side of the guide member PF is disposed beneath the overhanging edge of the container wall LA1 at a narrow gap k. The paper web then passes downwardly into the container disposed in a lower area US which contains a supply of solvent vapor where it is threaded around a reversing drum UE adjacent the floor of the container. The web is then passed upwardly in the container and directed about a second reversing drum UR whereupon it leaves the container BH through the common opening of the container where the web initially entered. In order to limit escape of solvent vapor out of the container operating opening, the upper guide member PF and the second reversing drum UR are disposed to take up space within the the opening. The upper guide member is provided with a depending support or bridge member ST to which a seal DI1 is affixed, which seal is a lip type seal resting against the outer surface of the drum UR. Between the drum UR and the container LA2, a second seal DI2, which is also a lip seal, is provided. Also in order to limit escape of solvent vapor from the lower area fixation zone US, the container BH is typically provided with cooling coils KL disposed within the container walls or affixed to the walls over the fixation zone. Solvent vapor emerging from the fixation zone US will then arrive at a cooled zone causing the vapor to condense. Typically, the solvent vapor is heavier than air.

Solvent is delivered to the bottom of the container BH by means of an inlet tube RO. Disposed in the floor SS of the container is a heating unit HE, such as a heating coil for heating the solvent to a temperature such that it is vaporized. The guidance mechanism PF, UE, and UR for the paper web through the container BH is adjustable to facilitate threading of the paper web initially through the container. Accordingly, it is possible to raise the reversing drum UE from its lower fixing position within the fixation zone US to an upper position such that the drum may seat in a support bracket AN disposed in the operating opening. In order to move the reversing drum UE, an endless drive chain FK is connected about a guide roller RL1 stationarily mounted at the fixation zone, threaded about guide rollers RL2 and RL3 disposed adjacent the operating opening, and finally threaded around a suitably driven roller RL4. The roller RL2 is adjacent the support bracket AN in such a manner that the chain FK leaves from the fixation zone roller RL1 to the member AN. The reversing drum UE is suitably connected to the drive chain FK for movement therewith as disclosed in U.S. Pat. No. 4,264,304.

A problem arises in the operation of the conventional fixation station assembly in that toner powder disposed on the recording medium AT will deposit on the surface of the second reversing drum UR which, over the course of time, can lead to contamination, such as spotting, of the recording medium. It is known to position a stripper plate device DI2', in the form of a first lip plate which resiliently biases the recording medium against a stationary opposed lip plate, downstream of the drum UR for stripping toner accumulations from the recording medium. A drawback with this arrangement is that toner deposits accumulating in the flow gap between the stripper plates must be regularly cleaned or else there will be disruptions in the transport of the recording medium. Furthermore, if toner particles have not yet solidified on the recording medium, they will tend to deposit on the stripping plates of the device DI2' affecting printing quality.

An object of the present invention is to provide apparatus for a solvent vapor toner image fixing assembly used with electrostatic printing and copying machines which more completely reduces the level of solvent vapor losses without negatively influencing the feed operation or movement of the recording medium through the fixing station and which provides a more efficient and effective means for removing residues unavoidably collected on the recording medium during fixing operation.

SUMMARY OF THE INVENTION

In order to prevent solvent vapor escape from the open upper end of a solvent vapor fixing station container, a wedge-shaped sealing strip is disposed in the gap between the lower edge of a paper web reversing drum and the adjacent container wall for preventing flow of solvent vapor therethrough and a relatively enlarged upper guide member assembly is further provided in the container opening overlying the reversing drum which substantially closes the remainder of the container opening to ambient. A flow space is formed between the lower end of the reversing drum and the sealing strip which expands in cross-sectional area in the direction proceeding into the container such that an air pressure is produced which prevents outward flow of solvent vapor therethrough. Further, since the reversing drum rotates in the direction toward the container interior along this flow gap, the boundary layer flows therealong are directed into the fixing container. The sealing strip is, however, spaced from the lower end of the reversing drum such that toner accumulations which may arise on the drum do not deposit on the sealing strip.

Means are further provided along the travel path of the paper web as it leaves the reversing drum outside of the container to remove solvent and toner residues formed on the recording medium. This means comprises a substantially rectangular housing defining a channel longitudinal with the recording medium and slightly wider than the recording medium for containing a suction flow of ambient air in counterflow to the travel direction of the recording medium. The upper end of this housing is connected directly to the exterior end of the sealing strip, preferably in the manner of an integral connection. The lower end of the housing from which the recording medium exits is open to ambient and adjacent the upper end suction manifolds are disposed in communication with the housing channel on opposed face sides of the recording medium for drawing air flow upwardly through the channel to a source of suction pressure.

For threading of the paper web through the fixing container, a lead end of the web is first passed over the guide member which is laterally movable out from the container opening. This lead and is then passed directly through the channel housing in that the channel housing is formed with a pivotable face wall, which is preferably the outer wall of the housing opposed from the container. The upper guide member is then passed into the container opening with the paper web threaded about the vertically adjustable reversing drum disposed in the container for positioning in the solvent vapor fixing zone.

Other objects, features, and advantages of the invention will be readily apparent from the following description of the preferred embodiment thereof, taken in conjunction with the accompanying drawings, although variations and modifications may be effected without departing from the spirit and scope of the novel concepts of the disclosure.

DESCRIPTION OF THE PREFERRED EMBODIMENT

Figure 1:
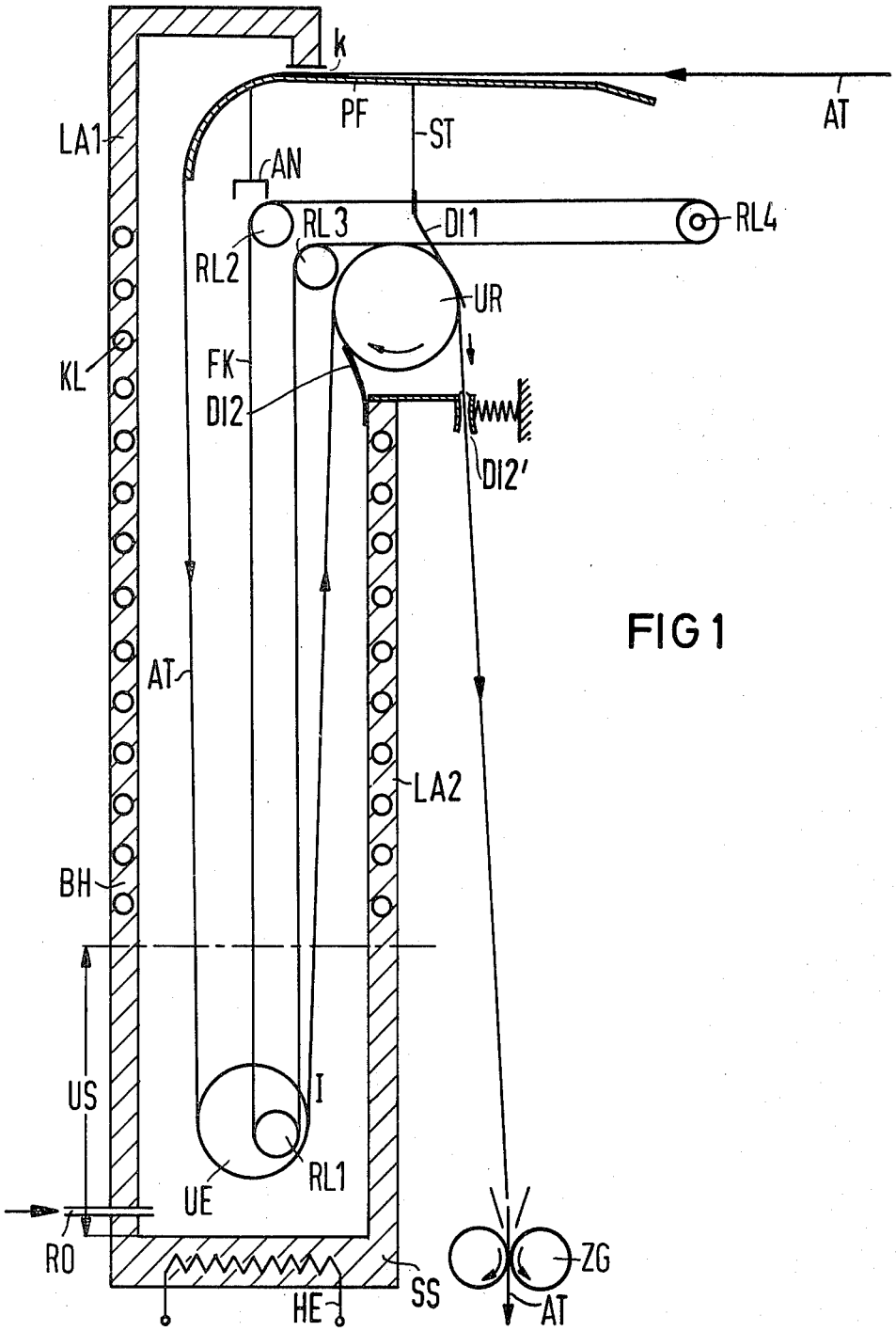
FIG. 1 is a schematic, side elevational crosss-sectional view of a solvent vapor fixing station constructed in accordance with the prior art.

FIG. 1 illustrates the principle features of a typical solvent vapor fixing station for use in electrostatic printing or copying machines to fix toner images generated on a recording medium. The device of FIG. 1 has been described above and is generally in conformance with the fixing apparatus disclosed in U.S. Pat. No. 4,264,304.

Figure 2:
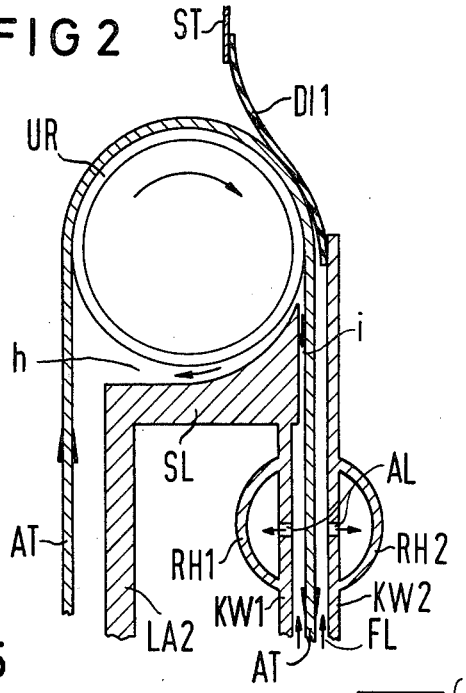
FIG. 2 is a fragmentary, side elevational cross-sectional view of a reversing drum and the lower edge of the operating opening in a solvent vapor fixing container constructed in accordance with the present invention.

FIG. 2 illustrates part of an improved fixing station container assembly constructed in accordance with the present invention which functions in accordance with the solvent vapor fixing principles used in the FIG. 1 device. Similar features to those shown in FIG. 1 will be used in describing the invention and those features will have like reference numerals from FIG. 1. FIG. 2 illustrates the second or upper end reversing drum UR in its operating condition during fixing operation. The drum UR is disposed for rotation in the direction of the arrow shown and is mounted immediately above the upper edge surface of the container sidewall LA2 for conducting a recording medium AT, in the form of a paper web, passing upwardly from the fixing zone US in the container over the container wall LA2 through the container upper end or operating opening for discharge passage vertically downward along the exterior surface of the wall LA2. The face surface of the recording medium containing the toner images being fixed faces the surface of the drum UR.

In accordance with the invention, a sealing strip member SL, which is wedge-shaped in lateral profile, is integrally formed at the upper edge of the container wall AL2. This sealing strip SL is formed with an upper curved surface which extends along a significant portion of the uncovered or free lower end circumference of the drum UR. The upper surface of the sealing strip SL is separated from the adjacent circumference of the drum UR by a gap h and the front facing sidewall of the sealing strip SL is disposed inward of the recording medium AT passing downwardly from the drum UR by a gap i. The gap i is formed of an approximately constant width. The gap h is formed of a width progressively increasing in the direction of rotation of the drum UR. The gaps h and i are interconnected at the narrow end of the gap h by virtue of the space formed between the drum UR and the initial spilled off portion of the paper web and the lead upper edge of the sealing strip SL. As a consequence, the gaps h and i exhibit boundary layer flows as a result of the movement of the drum UR and the recording medium AT which effect a flow of air having a general direction indicated by the arrows depicted in the gaps. This boundary layer flow through the gaps i and h serves to prevent the escape of solvent vapor from the container in the manner of a fluid seal in that the flow through gap h is in a direction opposite to that of the flow through the gap k disposed between the feed of recording medium AT into the container operating opening and the adjacent upper edge of the container wall LA1 (shown in FIG. 1). The flow through gap h and then through gap k at the upper end of the container BH effects a static pressure layer within the upper end of the container BH which prevents the upward escape of solvent vapor from the lower enclosed end of the container. By virtue of this inventive construction, no drag seal lip or flap, such as the seal flap DI2 shown in FIG. 1 is necessary at the upper end of the container wall LA2 on the recorded image side of the medium AT.

The following parameters for width or thickness dimensions to the gaps h, i, and k, given a reversing drum UR with an outside diameter of 60 mm and a longitudinal length of 500 mm are preferable: k being approximately 0.5 mm, i being approximately 1 through 2 mm, and h being approximately 0.2 through 0.5 mm initially and expanding then up to approximately 2 mm.

Figure 3:
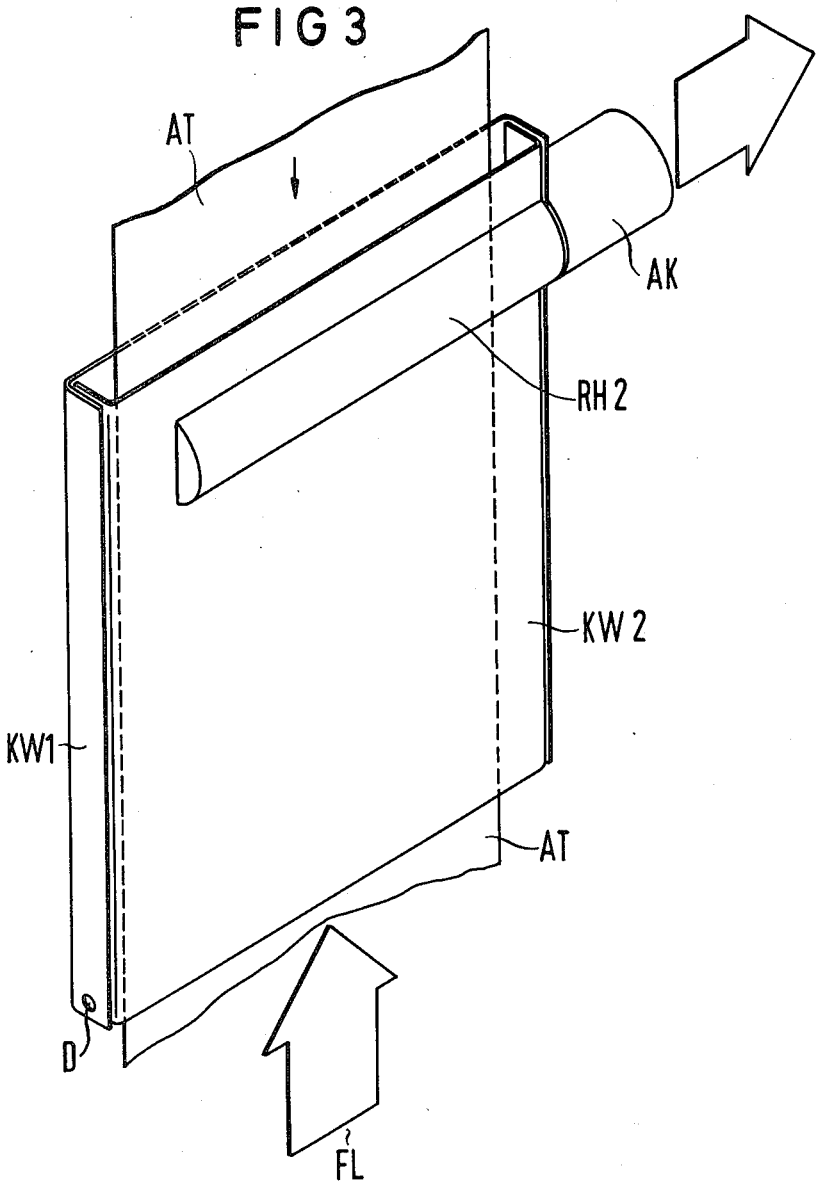
FIG. 3 is a schematic, perspective view of a paper web discharge housing disposed exterior of the container of FIG. 1.

With reference to FIGS. 2 and 3, there is connected extending downward from the outer free end of the sealing strip SL a fixed housing defining a vertical channel enclosing the web AT passing from the drum UR and forming a discharge channel through which the paper web is conducted immediately exterior of the container BH. The housing comprises a first, inner facing wall KW1, which may be integrally connected at its upper end to the sealing strip SL, and a second, outer facing wal KW2 disposed across the discharge channel from the first wall KW1, such that the housing is formed with a rectangular cross-section suitable for receiving the paper web AT therethrough. The housing is formed at its upper end with an inlet opening which receives the paper web AT spilling off the drum UR into the discharge channel. The upper end opening is defined between the front or outer facing surface of the sealing strip SL and a vertically extended end on the housing wall KW2. The operating opening of the container BH is sealed between the lower end of an upper support or guide member PF by means of a bridge structure ST extending downwardly from the upper guide member and a lip seal DI1 disposed between the lower end of the bridge ST and the upper surface of the drum UR.

The lip seal DI1 is preferably formed of a film of soft elastic material, such as polyuerthane, coated with a wear layer of suitable material, such as CrNi steel, at its side facing and disposed on the recording medium AT passing about the drum UR. By virtue of this construction, the serviceable life of the seal film DI1 is significantly increased and,, further, the coefficient of friction relative to the recording medium AT is reduced. The pressure exerted by the sealing film DI1 is selected such that it presses the recording medium AT smoothly against the drum surface along the full length of the drum UR. This is particularly advantageous when the recording medium is in the form of a continuous crosswise folded paper web, which folds tend to crimp up during transport. The necessary pressure of the sealing film DI1 against the recording medium on the drum UR is effected by virtue of the lower end connection of the seal DI1 against the inner surface of the housing wall KW2 which presses the dead weight of the sealing film against the recording medium on the drum.

Immediately below the sealing strip SL, a series of flow openings AL are formed along a common lateral plane in each of the walls KW1 and KW2 substantially across from one another. Corresponding manifolds RH1 and RH2, in the form of half tubes, are respectively attached along the exterior surfaces of the walls KW1 and KW2 for defining an enclosed air space communicating with the discharge opening AL. The manifolds RH1 and RH2 are closed at one lateral end and open at the other end for connection to a common duct AK, which may be fixed to one of the housing walls, here KW1. The duct AK is connected to a source of suction pressure and the lower end of the housing is open to ambient such that a flow of ambient air FL is drawn upwardly through the discharge channel through the openings AL and into the duct AK.

The recording medium AT emerging from the fixing container BH is thus conducted through a discharge channel which is fed with a forced air flow in a direction counterflow or opposite to that of the movement direction of the medium AT. In this manner, solvent and toner bonded by the recording medium AT are blown off the medium in the discharge channel and removed through the housing flow openings AL to the duct AK which may be formed with a solvent recovery system. Thus, the bonded solvent residues no longer uncontrollably escape into the environment and loss of solvent is further reduced. Furthermore, the discharge housing assembly serves to guarantee that the recording medium AT is properly dried and that the fixed or recorded images are free of loose toner before the recording medium, in this case a continuous paper web, is deposited in a folded stack.

Given the earlier recited dimensions for the gaps h and i, the flow rate of air through the discharge channel to the housing openings AL should not be greater than 15 $m^3/h$ so that the static pressure equilibrium effected at the upper end of the fixing container BH adjacent the operating opening does not become undesirably lowered.

Figure 4:
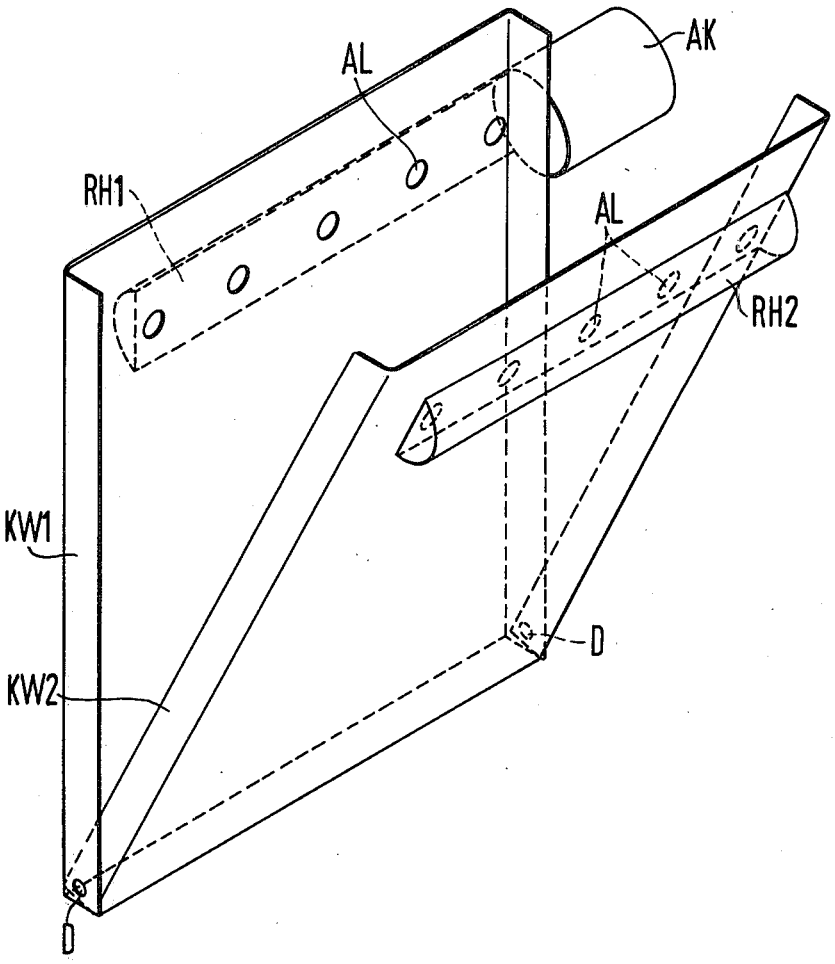
FIG. 4 is a schematic, perspective view of the discharge housing of FIG. 3 in its opened condition for threading.

FIG. 3 shows the discharge channel housing in a closed state during passage of the paper web AT therethrough in fixing operation. The front wall KW2 of the housing, however, is pivotally attached at its lower end by means of a pivot pin connection D with the inner housing wall KW1 in order to permit opening of the housing in the manner shown in FIG. 4. In the opened condition of the housing, the manifold RH2 is rotated out of communication with the duct AK, which is attached only to the inner wall KW1.

The pivot pin connections D at the lower end of the discharge housing are designed to permit adjustable vertical displacement of the outer housing wall KW2 relative to the inner wall KW1. In accordance with the preferred embodiment, the pivot pin connections are in the form of pivot pins engaging into oblong holes, such that the pivot points may be raised or lowered enabling the relatively extended upper end of the housing wall KW2 to be adjustably seated relative to the lower end of the sealing film DI1. In this manner, the stressing of the sealing film DI1 against the recording medium AT disposed on the drum UR can be adjustably set to achieve the necessary pressure so that the sealing film DI1 presses the recording medium AT smoothly against the drum surface.

Figure 5:
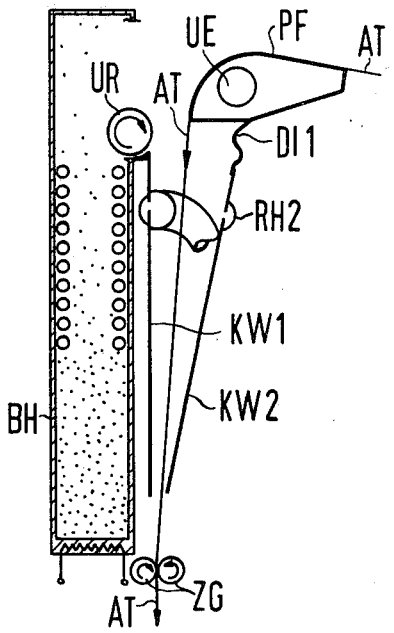
FIG. 5 is a schematic, side elevational cross-sectional view of the solvent vapor fixing station container constructed in accordance with the present invention during initial threading of the paper web through the discharge housing.
Figure 6:
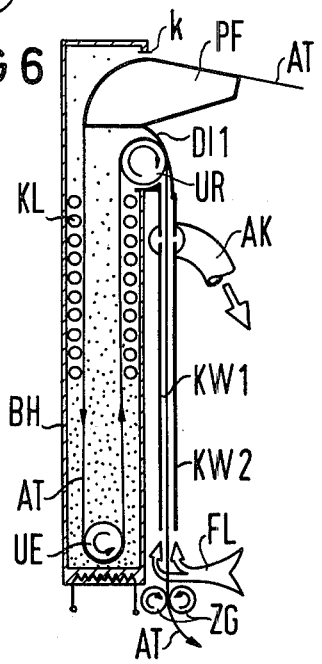
FIG. 6 is a schematic, side elevational cross-sectional view of the solvent vapor fixing station container construction of FIG. 5 during fixing operation.

Operation of the fixing station proceeds in the manner disclosed in U.S. Pat. No. 4,264,304. FIGS. 5 and 6 illustrate the workings of the inventive fixing station construction during threading and fixing operation, respectively. With reference to FIG. 5, the upper guide member PF is disposed for lateral movement into and out of the operational opening of the container BH in the known manner. The upper guide member contains a seating bracket, namely element AN shown in FIG. 1, for containing the first or fixing area reversing drum UE when it has been raised up within the container for threading of the recording medium. As shown in FIG. 5, the drum UE is seated on the upper guide member PF and moved together with the guide member PF laterally out of the container BH. At the same time, the pivotable discharge housing wall KW2 is pivoted away from the inner housing wall KW1 opening up the discharge housing vertically facing the guide member PF. At the opened position of the wall KW2 and the pulled-out position of the guide member PF, the sealing film DI1 is entrained over the raised upper end of the wall KW2. The recording medium AT is then directed across the upper surface of the guide member PF and its lead end is passed downwardly between the housing walls KW1 and KW2 through the lower end opening of the housing to be ceased in driving engagement between suitable tension rollers ZG.

The guide member PF is then inserted back laterally into the container BH and, at the same time, the housing wall KW2 is pivoted back into closed relationship with the inner housing wall KW1 such that the lead end of the recording medium AT is properly threaded through the housing discharge channel. With the guide member PF disposed in the container opening, the fixing drum UE is lowered down to the fixing zone US of the container, thus defining a travel path for the recording medium through the container which passes from the upper end of the container down towards the floor SS of the container, where the recording medium can be treated with solvent in the fixing zone. The recording medium is passed from the lowered fixing drum UE about the second reversing drum UR disposed over the sealing strip SL and then through the discharge housing to the tension rollers ZG.

The position of the elements of the inventive fixing station assembly during fixing operation are shown in FIG. 6. By virtue of the presence of the upper guide member PF, the sealing surfaces ST and DI1, the reversing drum UR, the sealing strip SL, and the container upper end pressure equilibrium brought about by flow through the gaps i, h, and k, the operational opening of the container BH is effectively sealed to prevent the emergence of solvent vapor from the container. During fixing operation, the recording medium passes into and out of the fixing container about the reversing drums UE and UR and then is conducted through the exterior mounted discharge housing through which a fresh air flow passes in counterflow relationship with the movement of the recording medium to provide full drying of the recording medium and removal of residues bonded to the recording medium during passage through the fixing container. By virtue of the fresh air flow through the discharge channel of the discharge housing, solvent vapor is prevented from emerging from the fixing assembly carried on the recording medium and that solvent entrained in the discharge channel air flow may be expediently collected from a suitable recovery system connected to the suction flow duct AK connected to the discharge housing.

The fixing container assembly of the present invention is of a construction which is easy to manipulate for threading up of the recording medium and which is largely free of maintenance problems. The fixing station device of the present invention provides for an extremely low solvent loss from the fixing station and assures effective curing of the recorded images formed on the recording medium.

Although various minor modifications may be suggested by those versed in the art, it should be understood that I wish to embody within the scope of the patent warranted hereon all such modifications as reasonably and properly come within the scope of my contribution to the art.

I claim as my invention:

1. In a fixing station assembly for fixing toner powder images applied to a recording medium with a solvent vapor comprising a housing containing said solvent vapor having an upper end opening and a guidance mechanism for conducting said recording medium over a guide member disposed in said opening and about a first rotary drum disposed in a solvent vapor zone adjacent the lower end of said housing and a second rotary drum disposed in said opening beneath said guide member for exit from said housing, the apparatus beneath said guide member for exit from said housing, the apparatus for preventing the emergence of solvent vapor through said opening in a manner preventing smearing of said toner powder images comprising:

a sealing body extending upward from said housing beneath said second drum, and having an upper end spaced from and facing said second drum, a first clearance gap formed between a lower end of said second drum and said sealing body upper end, said first gap being of narrow cross-section for conducting an air flow into the upper end of said housing by the rotation of said second drum, a second clearance gap formed between an upper end of said guide member and said housing, said second gap being of a cross-section substantially equal to or less than any cross-section of said first gap, and sealing surface means disposed in said opening between said guide member and the upper end of said second drum.

2. The apparatus of claim 1, wherein said sealing body upper end facing said second drum is curved and defines said first gap cross-section as progressively expanding in the direction of rotation of said second drum.

3. The apparatus of claim 2, wherein said first gap is connected to a third clearance gap formed between an exterior face of said sealing body and the recording medium passing from said second drum.

4. The apparatus of claim 1, further comprising a channel structure disposed exterior of said housing, said channel structure having sidewalls enclosing a longitudinally extending free space, said sidewalls defining a upper end opening leading to said first clearance gap and a lower end opening connected by said free space for receiving therethrough said recording medium passing from said second drum, said channel structure having openings extending laterally through upper ends of opposed said sidewalls connected to a source of suction pressure for drawing an airflow from said lower end opening over said recording medium in counterflow relation to movement of said recording medium through said channel structure.

5. The apparatus of claim 4, wherein said channel structure has one said sidewall facing away from said housing and being pivotably connected at its lower end to said other sidewall.

6. The apparatus of claim 5, wherein ssaid sealing surface means comprises a flexible flap suggested from said guide member and having a lower end resting against the recording medium disposed about said second drum, said one sidewall having an upper end portion pressing said flap lower end against said recording medium and second drum.

7. The apparatus of claim 6, wherein said flexible flap is made of soft elastic material coated with a wear-resistant material on that flap side facing said recording medium.

8. The apparatus of claim 6, wherein said guide member is mounted for lateral movement out of said housing opening with said flap being movable with said guide member, said one sidewall upper end portion retaining contact with said flap lower end during outward movement of said housing opening by pivoting of said one sidewall away from said other sidewall.

9. For use with a fixing station assembly for fixing toner powder images applied to a recording medium with a solvent vapor comprising a housing containing said solvent vapor having an upper end opening and a guidance mechanism for conducting said recording medium over a guide member disposed in said opening and about a first rotary drum disposed in a solvent vapor zone adjacent the lower end of said housing and a second rotary drum disposed in said opening beneath said guide member for exit from said housing, apparatus for removing residues from said recording medium exiting said housing in a manner preventing smearing of said toner powder images comprising:

a channel structure disposed exterior of said housing and having sidewalls enclosing a longitudinally extending from space, said sidewalls defining an upper end opening adjacent said second drum and a lower end opening connected by said free space for receiving therethrough said recording medium passing from said second drum, flow openings disposed adjacent the upper end of said channel structure and laterally extending in opposed said sidewalls communicating with said free space, and a source of suction pressure connected to said flow openings for drawing an airflow from said lower end opening over said recording medium in counterflow relation to movement of said recording medium through said channel structure.

* * * * *